US006720721B2

(12) United States Patent
Itou

(10) Patent No.: US 6,720,721 B2
(45) Date of Patent: Apr. 13, 2004

(54) COLOR CATHODE RAY TUBE HAVING AN IMPROVED SHADOW MASK SUPPORTING STRUCTURE

(75) Inventor: Youichi Itou, Mobara (JP)

(73) Assignee: Hitachi, Ltd., Tokyo (JP)

( * ) Notice: Subject to any disclaimer, the term of this patent is extended or adjusted under 35 U.S.C. 154(b) by 131 days.

(21) Appl. No.: 09/928,340

(22) Filed: Aug. 14, 2001

(65) Prior Publication Data

US 2002/0027407 A1 Mar. 7, 2002

(30) Foreign Application Priority Data

Sep. 4, 2000 (JP) ..... 2000-266557

(51) Int. Cl.[7] ..... H01J 29/80
(52) U.S. Cl. ..... 313/404; 313/406
(58) Field of Search ..... 313/406, 402, 313/404, 407

(56) References Cited

U.S. PATENT DOCUMENTS

| | | | |
|---|---|---|---|
| 5,012,154 A | 4/1991 | Ragland, Jr. | 313/406 |
| 5,210,459 A | 5/1993 | Lee | 313/406 |

FOREIGN PATENT DOCUMENTS

| | | |
|---|---|---|
| JP | 05089793 A | 4/1993 |
| JP | 08106856 A | 4/1996 |
| JP | 200067770 A | 3/2000 |
| JP | 2000133156 A | 5/2000 |
| JP | 2000277026 A | 10/2000 |
| KR | 1996-26001 | 7/1996 |

*Primary Examiner*—Nimeshkumar D. Patel
*Assistant Examiner*—Jason Phinney
(74) *Attorney, Agent, or Firm*—Antonelli, Terry, Stout & Kraus, LLP

(57) ABSTRACT

A color CRT has a panel portion with a phosphor screen and a shadow mask structure. The shadow mask structure has a support frame, a shadow mask, and suspension springs attached to corners of the support frame. Studs are embedded in corners of the panel portion for supporting the shadow mask structure. Each suspension spring includes a base member and a spring member. The spring member includes a sloped portion extending axially and bent outwardly, an engagement portion formed with a hole engaged with one of the studs, and a step-like portion provided between the sloped portion and the engagement portion. The step-like portion protrudes the engagement portion toward the stud such that a center of the hole engaged with the stud is displaced toward the skirt portion of the panel portion from an intersection of an axis of the stud with an imaginary plane projected from the sloped portion.

10 Claims, 12 Drawing Sheets

COLOR CATHODE RAY TUBE HAVING AN IMPROVED SHADOW MASK SUPPORTING STRUCTURE

BACKGROUND OF THE INVENTION

The present invention relates to a shadow mask type color cathode ray tube, and in particular to a color cathode ray tube of the type having its shadow mask supported at its corners.

As image or video display devices, shadow mask type color cathode ray tubes are widely used which employ a shadow mask which is formed with a large number of electron-transmissive apertures and serves as a color selection electrode.

A color cathode ray tube of this kind has an approximately rectangular panel portion having a spherical, flat or approximately flat outer surface and an inner surface which is convex toward the outer surface. Formed on the inner surface of the panel portion is a phosphor screen comprised of phosphor elements of a plurality of colors (usually three colors of red, green and blue) in the form of dots, slots or continuous strips.

An electron gun for projecting a plurality (usually three) of electron beams onto the phosphor screen is housed within a neck portion of the color cathode ray tube. A vacuum envelope of the color cathode ray tube is formed by integrally connecting the panel portion and the neck portion with a funnel portion.

Closely spaced from the phosphor screen within the panel portion is a shadow mask structure comprising a support frame (or a mask frame, or referred to merely as a frame) of a generally rectangular shape conforming to that of the panel portion, a generally rectangular shadow mask which is convex toward the phosphor screen and is attached to the support frame at its periphery, and suspension springs to be adapted to engage studs embedded into an inner sidewall of a skirt portion of the panel portion.

In this shadow mask structure, plate-like springs (leaf springs) are attached to the support frame along the sides of the support frame at at least three points of the support frame as by welding. The free ends of the leaf springs are formed with engagement holes which are adapted to engage the studs embedded in the inner sidewall of the skirt portion of the panel portion such that the shadow mask structure is supported and spaced by a specified distance from the phosphor screen.

Usually the leaf springs are attached to the four sides of the generally rectangular support frame, or to three of the four sides, and necessarily studs are embedded at positions of the inner sidewall of the skirt portion corresponding to the engagement holes in the leaf springs.

However, as the size of the viewing screen of color cathode ray tubes has been increasing recently, the weight of the shadow mask structure, and in particular of the support frame has increased and it is difficult for the above-described leaf springs to support the shadow mask structure properly and compensate for its positional deviations caused by thermal expansion of the mask structure sufficiently.

As one of means for reducing the weight of the shadow mask structure, and in particular of its support frame, a method is known to be effective which reduces the thickness and the width of the support frame and attaches suspension springs at the corners of the support frame.

FIG. 9 is a schematic plan view of the shadow mask structure having the suspension springs attached at its corners, as viewed from its electron gun side. A phosphor screen 4 is formed on the inner surface of a panel portion 1. A shadow mask 6 is disposed a specified distance from the phosphor screen 4, and suspension springs 8 attached to the four corners of a support frame 7 engage studs 9 embedded in the inner wall of the skirt portion of the panel portion 1. Lines of action of the suspension springs 8 are arranged approximately in parallel with the tube axis as described subsequently.

FIG. 10 is a perspective view of an exemplary configuration of the suspension springs 8 shown in FIG. 9. In FIG. 10, the suspension spring is generally designated as 8. Z'—Z' denotes its line of action which is approximately parallel with the longitudinal axis of the color cathode ray tube. The suspension spring 8 is formed by fixing an end of a spring member 82 to an end of a base member 81 as by welding. The fixed portion is indicated as a joint portion (a laminated portion) 83.

The base member 81 has a sloped portion 812 formed to make a small angle with respect to a flat portion 811 to project upwardly. The flat portion 811 is fixed to the support frame of the shadow mask structure. In this example, the flat portion 811 is formed with stepped portions 813. The stepped portions 813 are adapted to be inserted into slits (not shown) formed in the support frame such that locations of the suspension springs are determined and thereby the operation of attaching the suspension springs 8 is facilitated.

However, provision of the stepped portions 813 is not essential, or other means such as protrusions can be used for locating the suspension springs 8. The base member 81 can be made in the form of a flat plate, and can be welded directly to the sidewall of the support frame.

The spring member 82 has a flat portion 821 and a sloped portion (an operating portion) 822 extending from the flat portion 821 to the joint portion 83. The flat portion 821 is formed with an engagement hole 825 to be adapted to engage a stud (not shown). A washer is sometimes disposed between the stud 9 (see FIG. 9) and the engagement hole 825, but the washer is omitted in this specification.

Incidentally, a tab 823 is provided at an end of the flat portion 821 mainly for the purpose of rotating the spring member 82 in a direction indicated by an arrow "A" against resiliency of the sloped portion 822 in removing and remounting of the shadow mask structure by using a robot or manually. The tab 823 is not always necessary if the shadow mask structure can be removed and remounted by using the flat portion 821.

A conventional color cathode ray tube employing suspension springs of this type for supporting its shadow mask at its corners is disclosed in Japanese Patent Application Laid-open Hei 5-89793, for example.

SUMMARY OF THE INVENTION

It is a representative one of the objects of the present invention to provide a novel color cathode ray tube capable of compensating for a doming phenomenon occurring in a shadow mask properly and improving efficiency in the operation of removing and remounting the shadow mask structure.

To accomplish the above object of the present invention, in accordance with an embodiment of the present invention, there is provided a color cathode ray tube comprising an evacuated envelope including a generally rectangular shallow dish-like panel portion having a peripheral skirt portion, a tubular neck portion, and a funnel portion for connecting the panel portion and the neck portion, an electron gun housed within the neck portion, a phosphor screen formed on an inner surface of the panel portion, a shadow mask structure closely spaced from the phosphor screen within the panel portion, the shadow mask structure comprising a generally rectangular peripheral support frame, a generally rectangular shadow mask having an apertured portion formed with a multiplicity of electron-transmissive apertures and a peripheral skirt portion, the shadow mask being attached at the peripheral skirt portion thereof to the support frame, and suspension springs attached to corners of the support frame corresponding to the corners of the panel portion, and a plurality of studs embedded in an inner wall of the skirt portion at corners of the panel portion for supporting the shadow mask structure, wherein each of the suspension springs comprises a base member fixed to a corresponding one of the corners of the support frame, and a spring member fixed at a panel-portion side end thereof to the base member; and the spring member includes a resilient sloped portion extending in a direction of a longitudinal axis of the color cathode ray tube from the panel-portion side end of the spring member, and bent toward the skirt portion of the panel portion from the direction of the longitudinal axis of the color cathode ray tube, an engagement portion formed with an engagement hole engaged with a corresponding one of the plurality of studs, and a generally step-like portion provided between the resilient sloped portion and the engagement portion for protruding the engagement portion toward the corresponding one of the plurality of studs such that a center of the engagement hole in a condition thereof engaged with the corresponding one of the plurality of studs is displaced toward the inner wall of the peripheral skirt portion of the panel portion from an intersection of a longitudinal axis of the corresponding one of the plurality of studs with an imaginary plane projected from the resilient sloped portion.

To accomplish the above object of the present invention, in accordance with another embodiment of the present invention, there is provided a color cathode ray tube comprising an evacuated envelope including a generally rectangular shallow dish-like panel portion having a peripheral skirt portion, a tubular neck portion, and a funnel portion for connecting the panel portion and the neck portion, an electron gun housed within the neck portion, a phosphor screen formed on an inner surface of the panel portion, a shadow mask structure closely spaced from the phosphor screen within the panel portion, the shadow mask structure comprising a generally rectangular peripheral support frame, a generally rectangular shadow mask having an apertured portion formed with a multiplicity of electron-transmissive apertures and a peripheral skirt portion, the shadow mask being attached at the peripheral skirt portion thereof to the support frame, and suspension springs attached to corners of the support frame corresponding to the corners of the panel portion, and a plurality of studs embedded in an inner wall of the skirt portion at corners of the panel portion for supporting the shadow mask structure, wherein each of the suspension springs comprises a base member fixed to a corresponding one of the corners of the support frame, and a spring member fixed at a panel-portion side end thereof to the base member; and the spring member includes a resilient sloped portion extending in a direction of a longitudinal axis of the color cathode ray tube from the panel-portion side end of the spring member, and bent toward the skirt portion of the panel portion from the direction of the longitudinal axis of the color cathode ray tube, and an engagement portion continuous with the resilient sloped portion and having an engagement hole engaged with a corresponding one of the plurality of studs, the engagement hole being made in a protuberant central area raised above a surrounding surface of the engagement portion for protruding the engagement hole toward the corresponding one of the plurality of studs such that a center of the engagement hole in a condition thereof engaged with the corresponding one of the plurality of studs is displaced toward the inner wall of the peripheral skirt portion of the panel portion from an intersection of a longitudinal axis of the corresponding one of the plurality of studs with an imaginary plane projected from the resilient sloped portion.

To accomplish the above object of the present invention, in accordance with another embodiment of the present invention, there is provided a color cathode ray tube comprising an evacuated envelope including a generally rectangular shallow dish-like panel portion having a peripheral skirt portion, a tubular neck portion, and a funnel portion for connecting the panel portion and the neck portion, an electron gun housed within the neck portion, a phosphor screen formed on an inner surface of the panel portion, a shadow mask structure closely spaced from the phosphor screen within the panel portion, the shadow mask structure comprising a generally rectangular peripheral support frame, a generally rectangular shadow mask having an apertured portion formed with a multiplicity of electron-transmissive apertures and a peripheral skirt portion, the shadow mask being attached at the peripheral skirt portion thereof to the support frame, and suspension springs attached to corners of the support frame corresponding to the corners of the panel portion, and a plurality of studs embedded in an inner wall of the skirt portion at corners of the panel portion for supporting the shadow mask structure, wherein each of the suspension springs comprises a base member fixed to a corresponding one of the corners of the support frame, and a spring member fixed at a panel-portion side end thereof to the base member; and the spring member includes a resilient sloped portion extending in a direction of a longitudinal axis of the color cathode ray tube from the panel-portion side end of the spring member, and bent toward the skirt portion of the panel portion from the direction of the longitudinal axis of the color cathode ray tube, and an engagement hole engaged with a corresponding one of the plurality of studs is made in a protuberant central area raised above a surrounding surface of the resilient sloped portion for protruding the engagement hole toward the corresponding one of the plurality of studs such that a center of the engagement hole in a condition thereof engaged with the corresponding one of the plurality of studs is displaced toward the inner wall of the peripheral skirt portion of the panel portion from an intersection of a longitudinal axis of the corresponding one of the plurality of studs with an imaginary plane projected from the resilient sloped portion.

The present invention is not limited to the above configurations or the configurations of the embodiments described subsequently, and various changes and modifications may be made without departing from the scope of the invention as defined in the appended claims.

BRIEF DESCRIPTION OF THE DRAWINGS

In the accompanying drawings, in which like reference numerals designate similar components throughout the figures, and in which.

DETAILED DESCRIPTION

Figure 11:
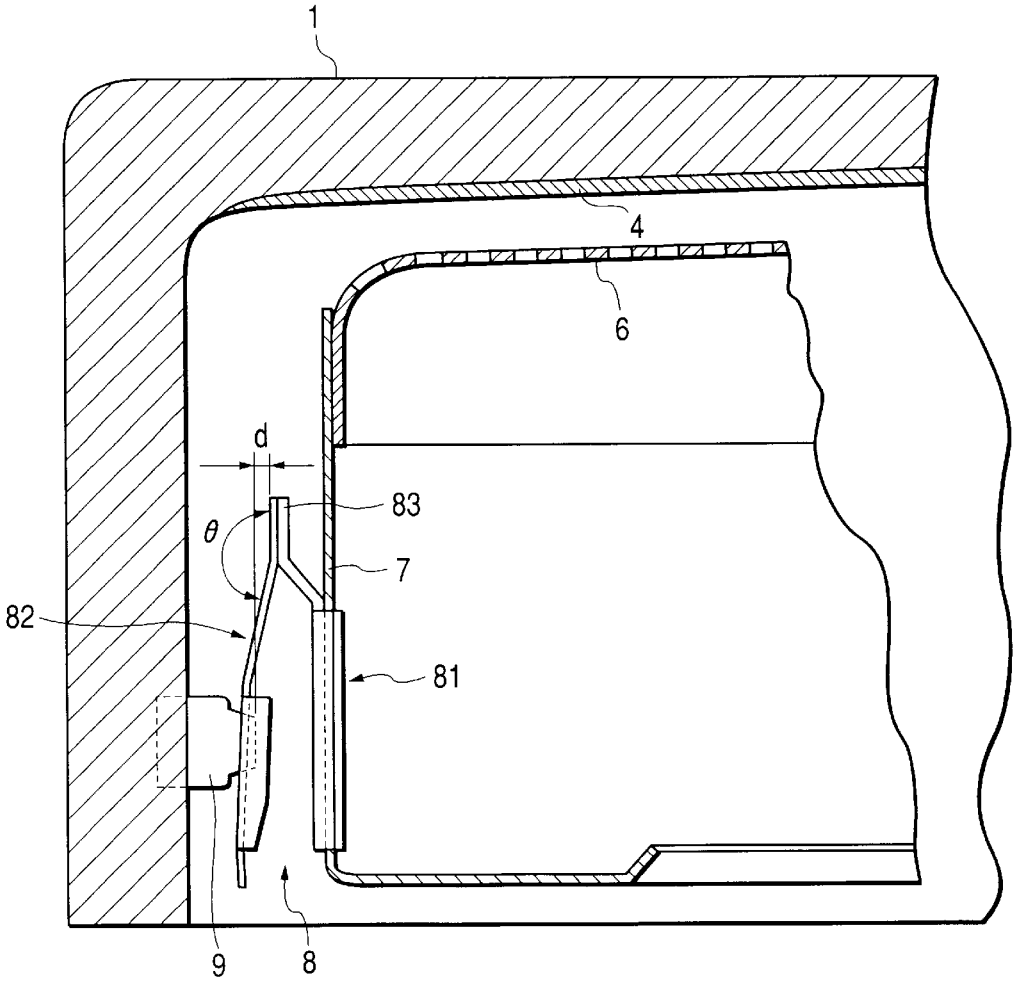
FIG. 11 is a cross-sectional view of an essential part of a panel portion of a color cathode ray tube taken along a plane parallel with its tube axis for explaining the condition of the shadow mask structure mounted within the panel portion.

FIG. 11 is a cross-sectional view of an essential part of a panel portion of a conventional color cathode ray tube taken along a plane parallel with its tube axis for explaining the condition of the shadow mask structure mounted within the panel portion. In FIG. 11, reference numeral 1 denotes the panel portion, and studs 9 are embedded into the inner wall of the periphery (the skirt portion) of the panel portion 1 at the corners of the panel portion 1.

Formed on the inner surface of the panel portion 1 serving as a viewing screen is a phosphor screen 4 comprised of a mosaic of different-color-emitting phosphor areas. The base members 81 of the suspension springs 8 are fixed to the support frame 7 of the shadow mask structure, and the engagement holes formed in the spring members 82 of the suspension springs 8 engage the studs 9, and thereby the shadow mask 6 is disposed a specified distance from the phosphor screen 4.

The shadow mask 6 is deformed due to temperature rise during operation of the color cathode ray tube, and moves toward the phosphor screen 4 as a whole, which is the so-called doming phenomenon, and consequently, electron beams passing through electron-transmissive apertures in the shadow mask 6 do not impinge upon intended phosphor elements properly and thereby cause color impurity.

For the purpose of reducing the degree of doming, the shadow mask 6 is made of Invar (an iron-nickel alloy containing about 36 percent nickel) material having a low coefficient of thermal expansion. On the other hand, the support frame 7 and the suspension springs 8 are made of steel, and consequently, the amounts of distortions of the support frame 7 and the suspension springs 8 due to temperature rise become greater than the amount of distortion of the shadow mask 6.

In FIG. 11, the amount of compensation of the doming phenomenon by the suspension spring 8 is determined by a tilt angle θ of the spring member 82. The suspension spring 8 is attached such that it compensates for the above-explained doming by absorbing thermal distortion of the shadow mask and the support frame, but, when the shadow mask made of material of a low thermal coefficient of expansion is employed, the suspension spring 8 compensates for the amount of doming more than necessary, that is, the suspension spring 8 overcompensates for doming.

For reducing the amount of doming compensation by the suspension spring 8, it is necessary to dispose the joint portion 83 of the suspension spring 8 shown in FIG. 11 as close to the inner wall of the skirt portion of the panel portion 1 as possible.

However, if the joint portion 83 of the suspension spring 8 is disposed closer toward the inner wall of the skirt portion of the panel portion 1, the spacing between the joint portion 83 and the top of the stud 9 becomes smaller, and consequently, the joint portion 83 and the stud 9 interfere with each other (contact or collision) in removing and remounting of the shadow mask structure during the operation of coating the phosphor screen, and as a result the stud 9 is destroyed or the need for avoiding the interference degrades operation efficiency.

Figure 12:
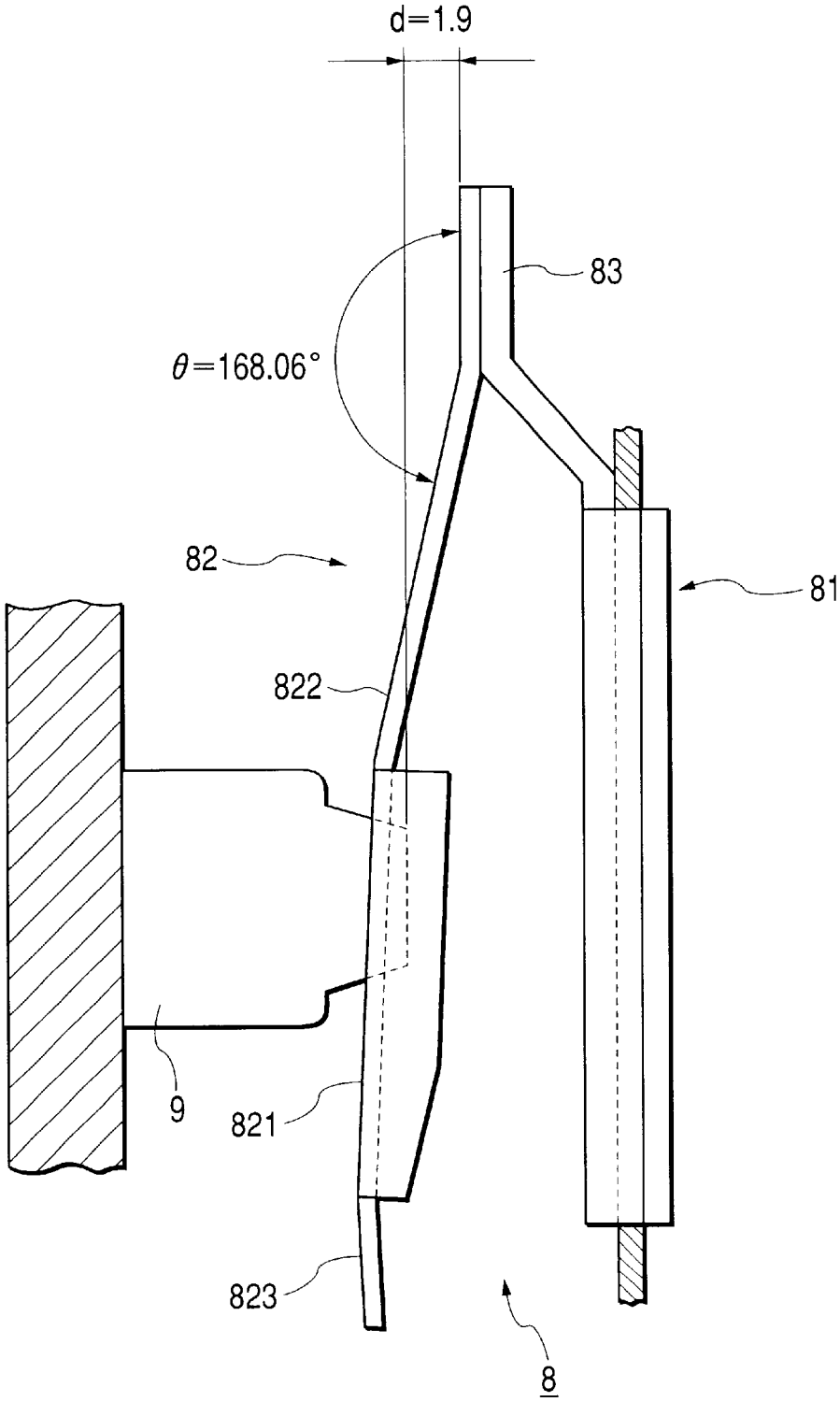
FIG. 12 is an illustration for explaining a minimum interference-free distance between a stud and the suspension spring which produces a large amount of doming compensation.

FIG. 12 is an illustration for explaining a minimum interference-free distance between the stud 9 and the suspension spring 8 which produces a large amount of doming compensation. The minimum interference-free distance d (mm) between the stud 9 and the joint portion 83 of the suspension spring 8 is about 1.9 mm when the accuracy of actual operation of a machine for removing and remounting of the shadow mask structure is taken into account, and this minimum interference-free distance of 1.9 mm corresponds to a tilt angle θ of 168.06 degrees of the spring member 82 with respect to the joint portion 83.

When the shadow mask 6 is made of Invar, the suspension spring 8 having the tilt angle of such a value provides an excessive amount of doming compensation, and therefore cannot eliminate color misregister caused by temperature rise.

Figure 13:
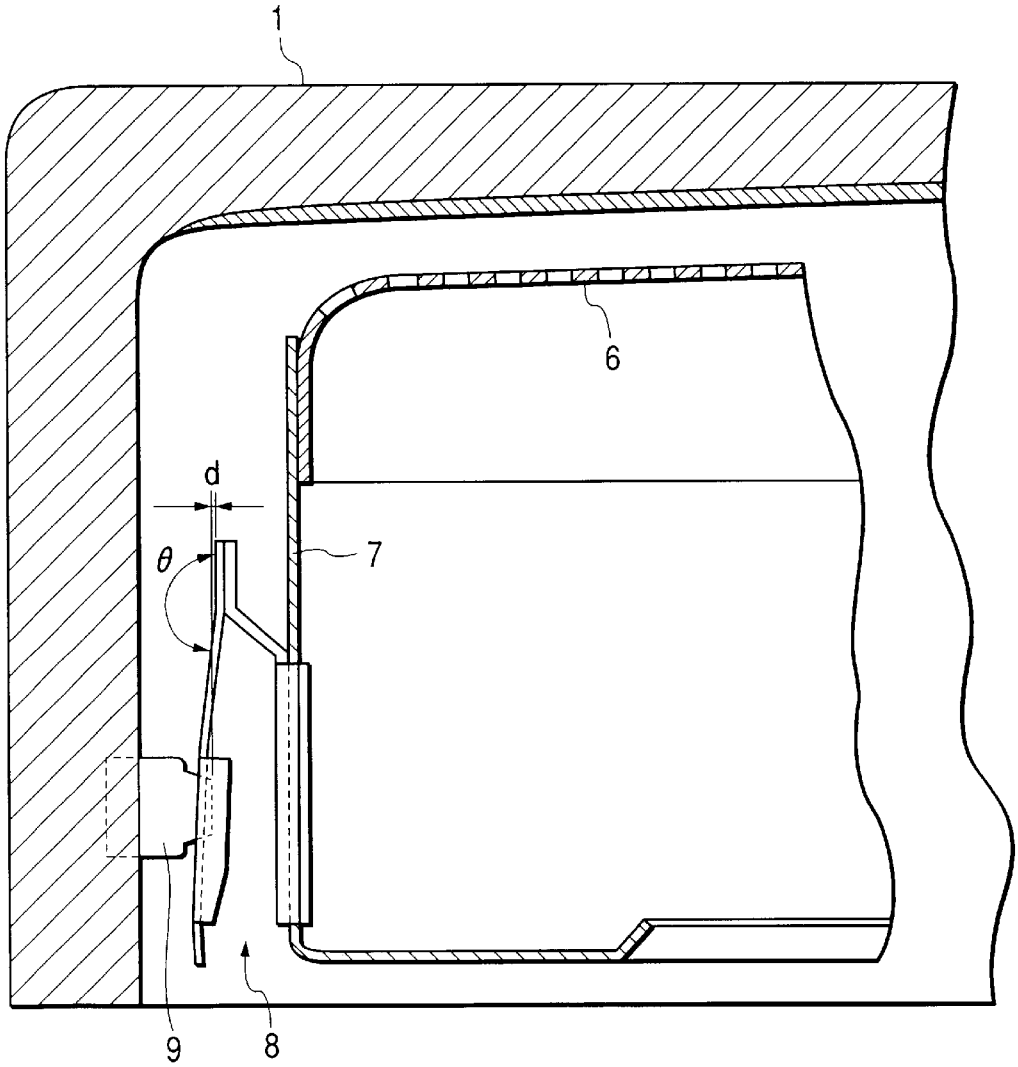
FIG. 13 is a cross-sectional view of an essential part of a panel portion of a color cathode ray tube taken along a plane parallel with its tube axis when a joint portion of the suspension spring is disposed closer toward the inner sidewall of the skirt portion of its panel portion so as to increase the tilt angle θ.
Figure 14:
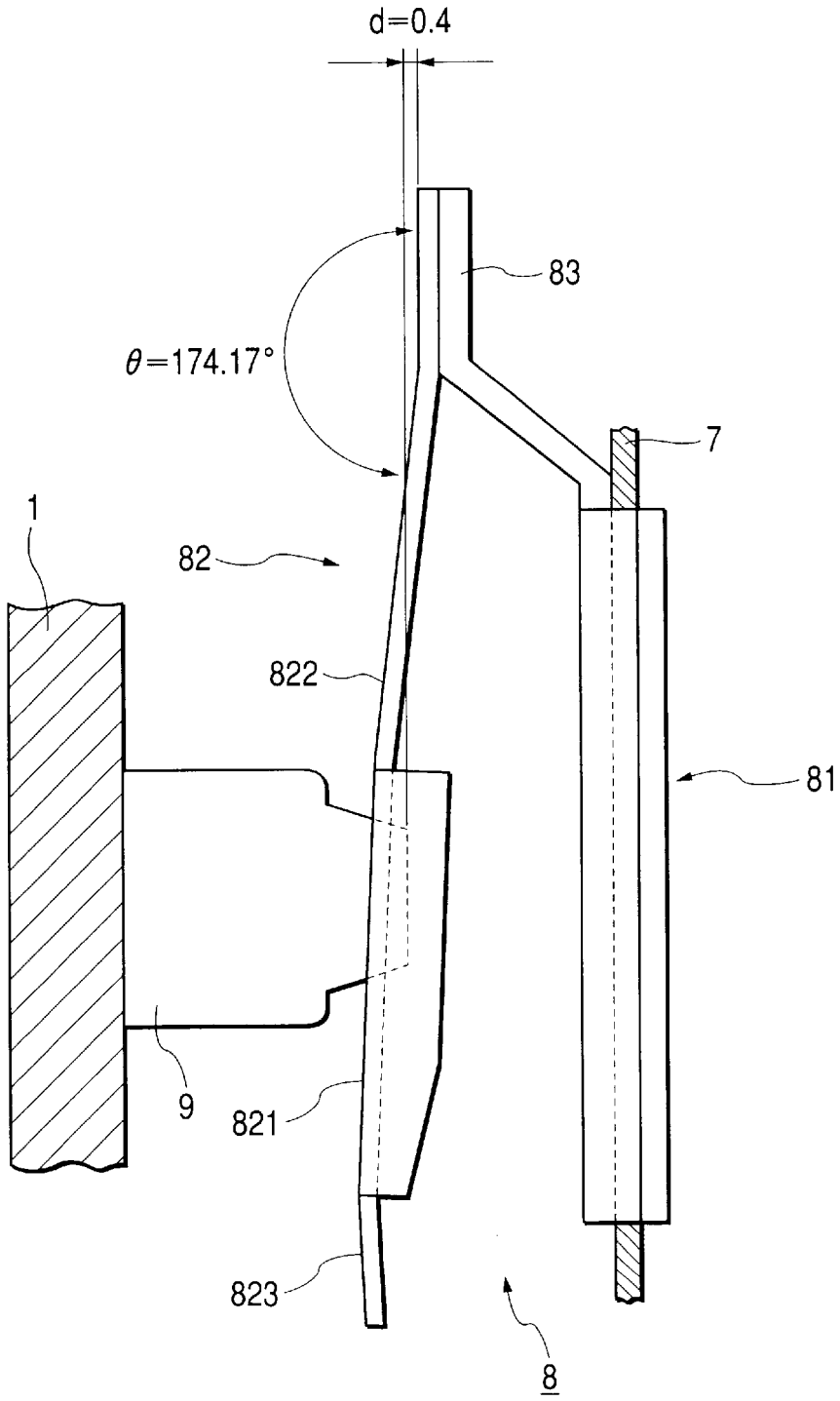
FIG. 14 is an enlarged view of the suspension spring and its vicinity in FIG. 13.

FIG. 13 is a cross-sectional view of an essential part of a panel portion of a color cathode ray tube taken along a plane parallel with its tube axis when the joint portion of the suspension spring 8 is disposed closer toward the inner sidewall of the skirt portion of its panel portion to increase the tilt angle θ, and FIG. 14 is an enlarged view of the suspension spring 8 and its vicinity of FIG. 13.

With the structure of FIGS. 13 and 14, the amount of doming compensation can be reduced by making the tilt angle θ of 174.17 degrees greater than the above-mentioned tilt angle, and consequently, the above-explained overcompensation can be avoided. However, the minimum interference-free distance d between the stud 9 and the joint portion 83 of the suspension spring 8 become about 0.4 mm, and consequently, it is practically difficult to remove and remount the shadow mask structure into the panel portion 1.

As explained above, with the conventional configurations of the suspension spring, the doming compensation is not compatible with removing and remounting of the shadow mask structure, and this has been one of problems with the conventional color cathode ray tubes.

The embodiments of a color cathode ray tube in accordance with the present invention will now be explained in detail by reference to the drawings.

Figure 1:
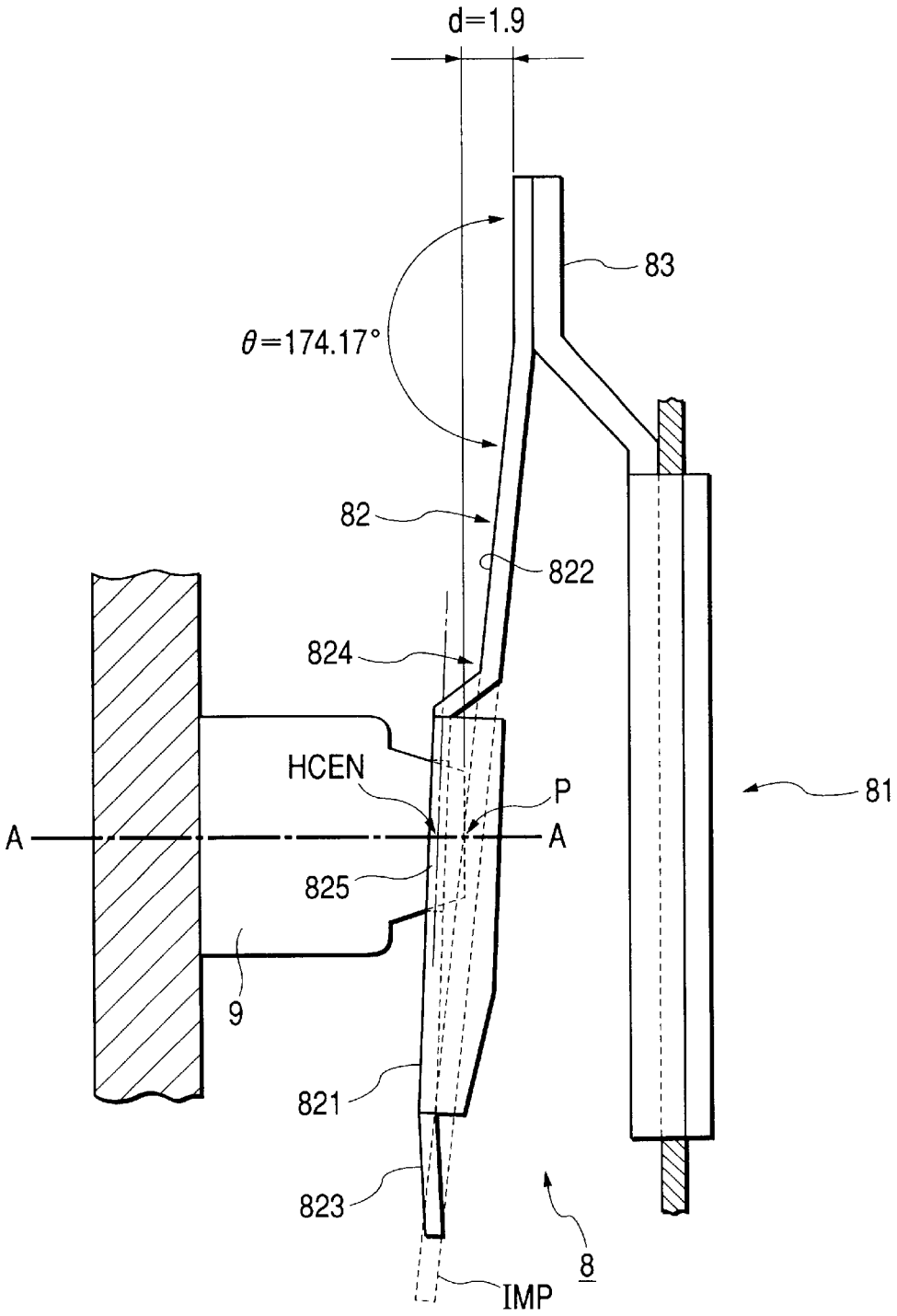
FIG. 1 is a cross-sectional view of an essential part of a first embodiment of the color cathode ray tube in accordance with the present invention for explaining the condition of a suspension spring engaging a stud.
Figure 2:
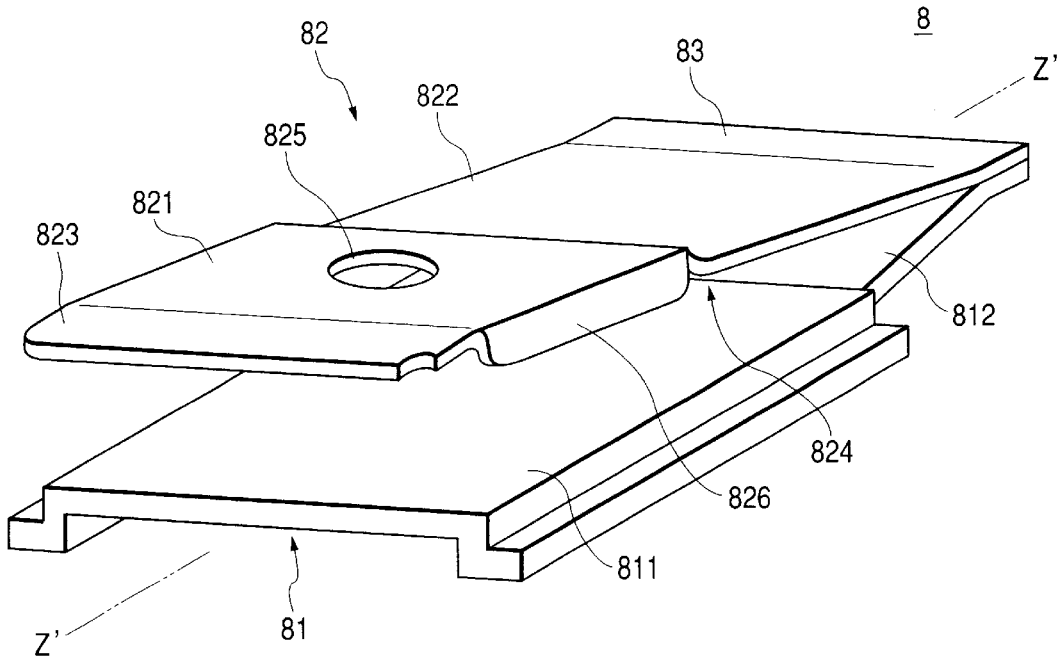
FIG. 2 is a perspective view of the suspension spring of the first embodiment for explaining its overall configuration.
Figure 3:
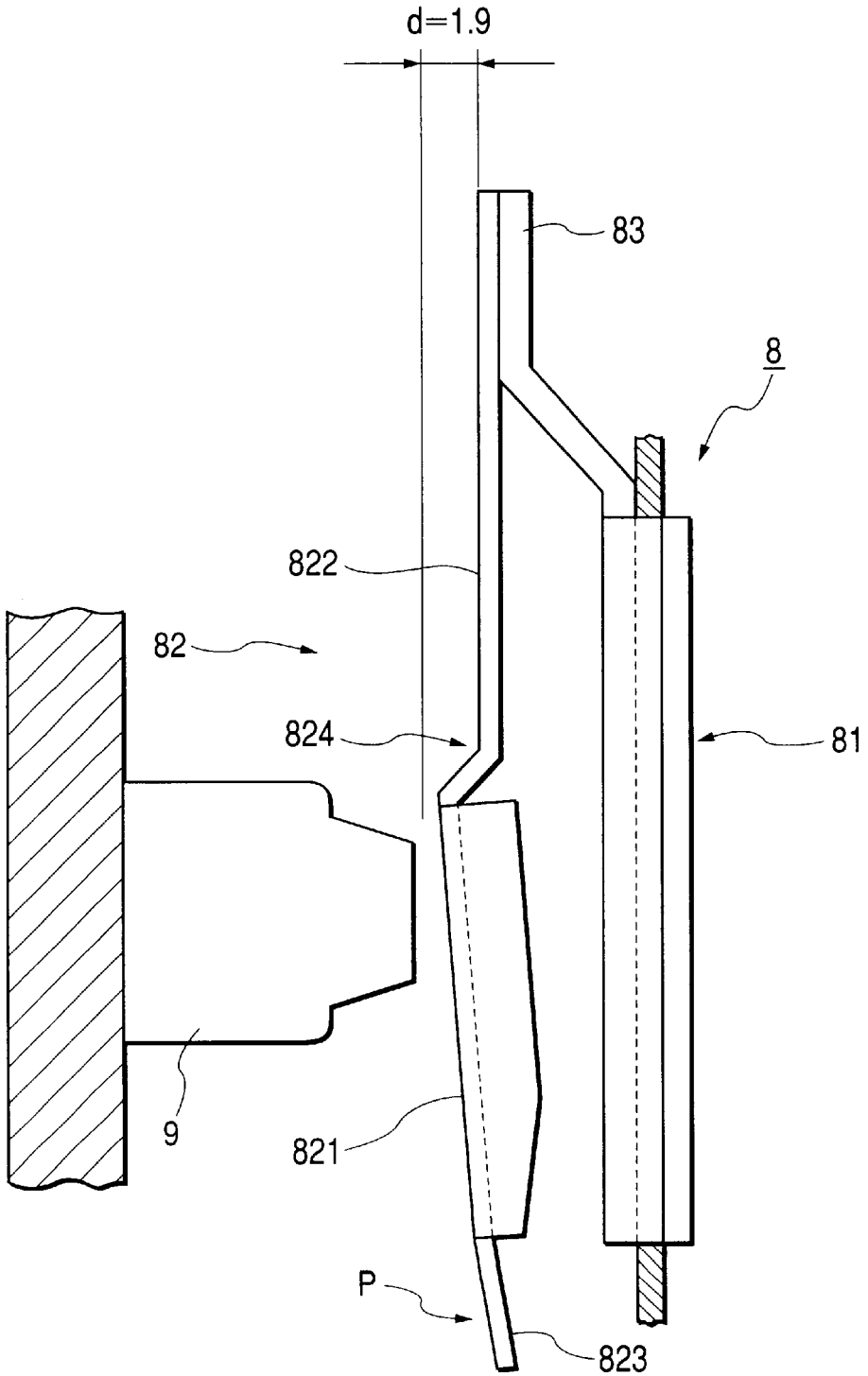
FIG. 3 is an illustration for explaining removing and remounting of the shadow mask structure employing the suspension spring of the first embodiment, within the panel portion.
Figure 4:
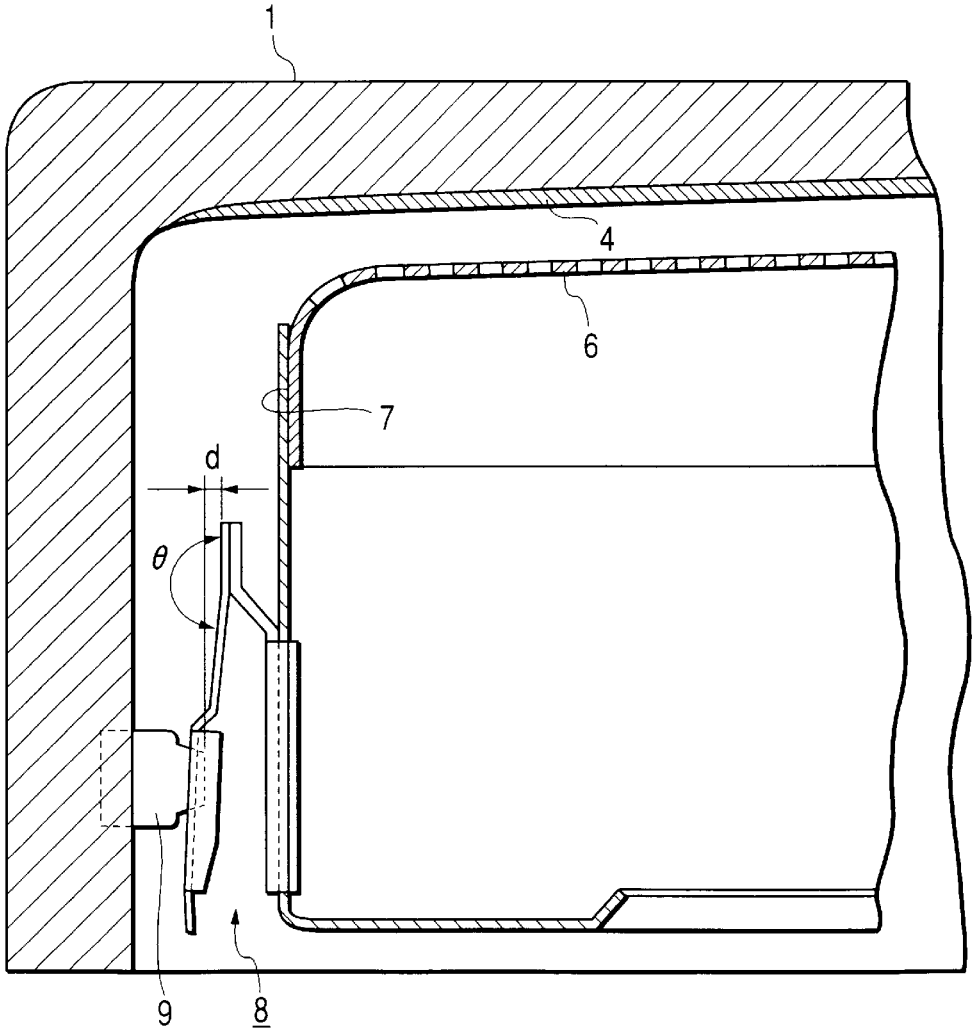
FIG. 4 is a cross-sectional view of the essential part of the panel portion for explaining the condition of the shadow mask structure mounted within the panel portion.
Figure 5A:
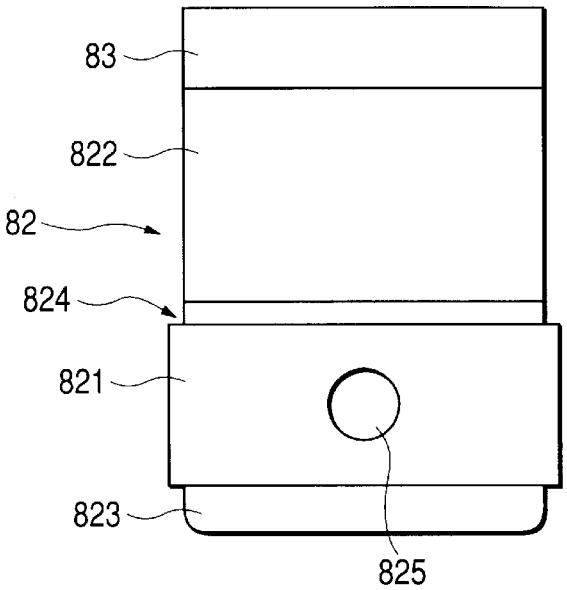
FIGS. 5A and 5B are plan and side views of a spring member constituting the suspension spring of the first embodiment, respectively.
Figure 5B:
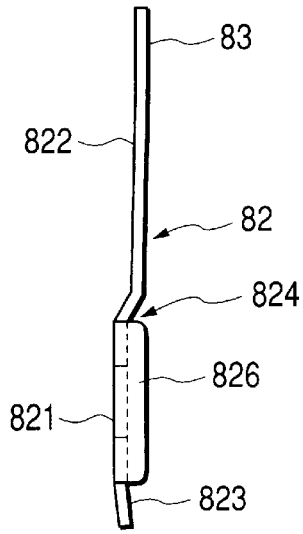

FIG. 1 is a cross-sectional view of an essential part of a first embodiment of the color cathode ray tube in accordance with the present invention for explaining the condition of the suspension spring engaging the stud, FIG. 2 is a perspective view of the suspension spring, FIG. 3 is an illustration for explaining removing and remounting of the shadow mask structure within the panel portion, FIG. 4 is a cross-sectional view of the essential part of the panel portion for explaining the condition of the shadow mask structure mounted within the panel portion. FIGS. 5A and 5B are plan and side views of a spring member constituting the suspension spring, respectively. The same reference numerals as utilized in FIGS. 9 to 14 designate functionally similar portions in FIGS. 1 to 5.

Figure 9:
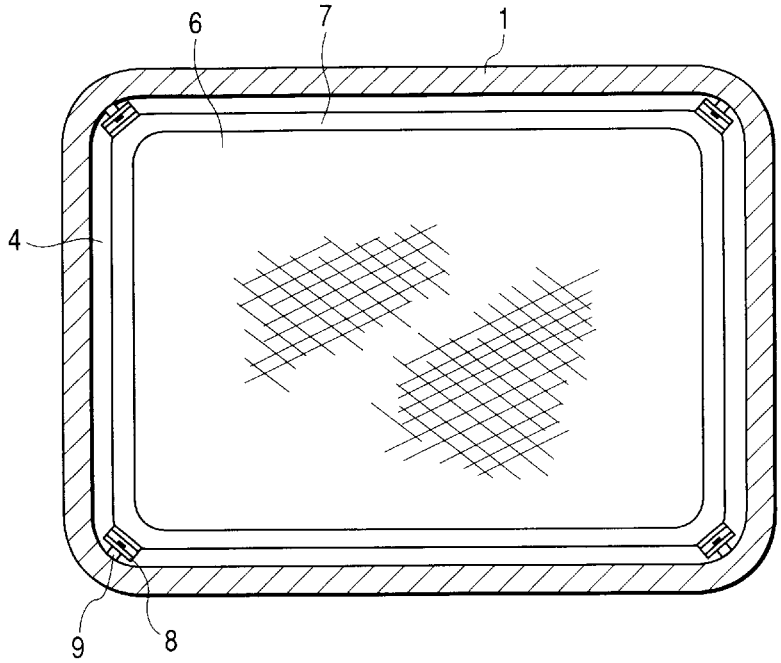
FIG. 9 is a schematic plan view of the shadow mask structure having the suspension springs attached at its corners, and mounted in the panel portion of a color cathode ray tube, as viewed from its electron gun side.
Figure 10:
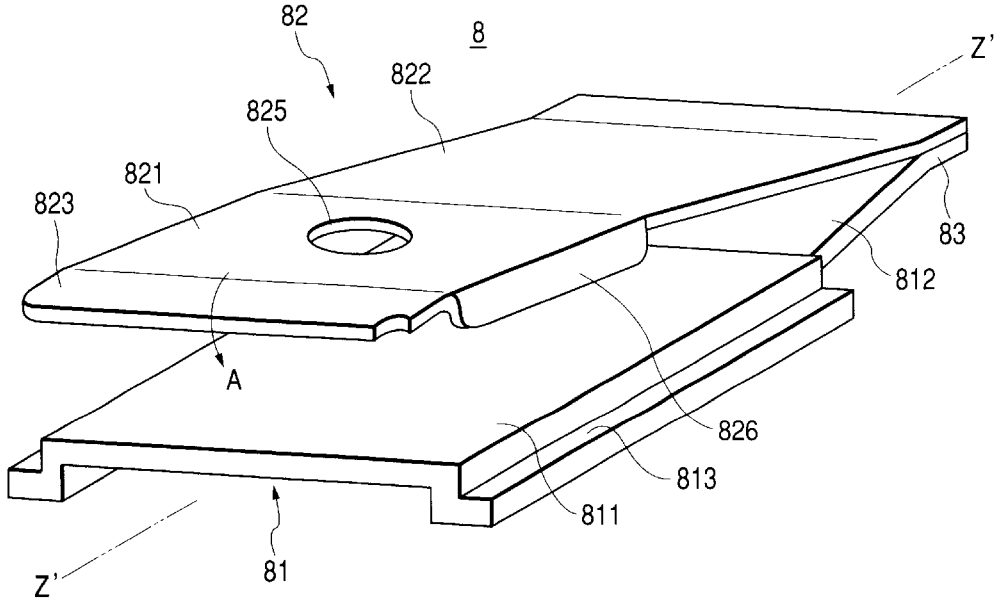
FIG. 10 is a perspective view of an exemplary configuration of the suspension springs shown in FIG. 9.

The suspension spring 8 in this embodiment has its base member 81 and its spring member 82 fixed together at their joint portion 83, and its detail is approximately similar to that explained in connection with FIG. 9.

For example, the base member 81 and the spring member 82 are made of stainless steel such as JIS (Japanese Industrial Standards) 304 stainless steel, the spring member 82 is 0.6 mm thick, and the base member 81 is selected to be 1.0 mm, thicker than the spring member 82 so as to prevent mechanical deformation, and the width of the base member 81 and the spring member 82 is 20 mm.

In this embodiment, the spring member 82 includes a sloped portion 822, a flat portion 821 and a stepped portion 824. The sloped portion 822 is formed to extend from the joint portion 83 toward the electron gun (downward in FIG. 1) and toward the skirt portion of the panel portion 1 at a specified angle with respect to the joint portion 83, and this sloped portion 822 provides a great portion of required spring action. The flat portion 821 is formed with an engagement hole 825 to be adapted to engage the stud 9 (5.6 mm in diameter, for example). The stepped portion 824 is disposed between the flat portion 821 and the sloped portion 822 to connect them together and to project the flat portion 821 toward the stud 9. The tilt angle θ of the sloped portion 822 with respect to the joint portion 83 is 174.7 degrees, and this value can suppress the doming overcompensation as in the case explained in connection with FIG. 13. In this embodiment, the minimum interference-free distance d between the stud 9 and the joint portion 83 of the suspension spring 8 is about 1.9 mm, and satisfies the required distance for removing and remounting of the shadow mask structure.

The suspension spring 8 of this embodiment is provided with the stepped portion 824 in the transition region between the sloped portion 822 extending from the joint portion 83 of the spring member 82 and the flat portion 821 connected to the sloped portion 822 as shown in FIG. 2.

The stepped portion 824 is sloped linearly downward toward the base member 81 from the flat portion 821 in the transition region between the sloped portion 822 and the flat portion 821. With this structure, when the engagement hole 825 is disengaged from the stud 9 by compressing a tab 823 in a direction P for removing or remounting of the shadow mask structure as shown in FIG. 3, a sufficient spacing is secured between the stud 9 and the joint portion 83 of the suspension spring 8.

In this way in this embodiment, the tilt angle θ of the sloped portion 822 determining the amount of doming compensation can be made greater than the conventional tilt angle explained in connection with FIG. 11, thereby the overcompensation of doming can be avoided, and further, the interference between the suspension spring and the stud can be prevented in the operation of removing and remounting of the shadow mask structure.

The present inventors have confirmed experimentally that, as shown in FIG. 1, the above-explained advantages are secured by providing a generally step-like portion 824 between the resilient sloped portion 822 and the flat portion 821 for protruding the flat portion 821 toward the stud 9 such that a center HCEN of the engagement hole 825 engaged with the stud 9 is displaced toward the inner wall of the skirt portion of the panel portion 1 from an intersection P of a longitudinal axis A—A of the stud 9 with an imaginary plane IMP (indicated by broken lines) projected from the resilient sloped portion 822.

Figure 6A:
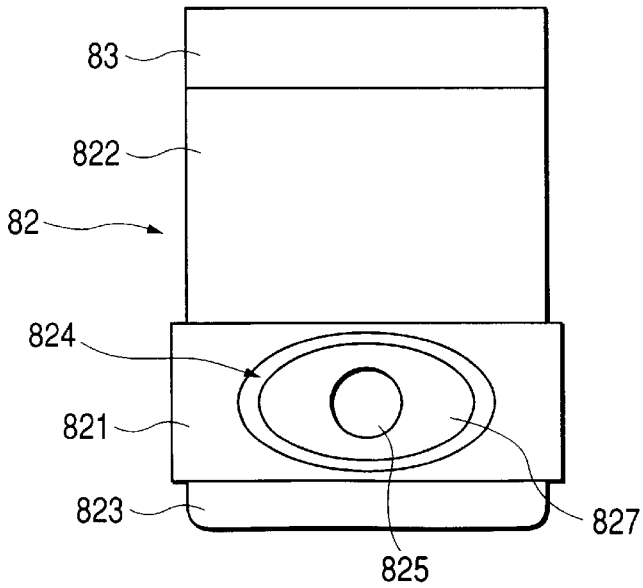
FIGS. 6A and 6B are plan and side views of a spring member constituting a suspension spring of a second embodiment of the color cathode ray tube in accordance with the present invention, respectively.
Figure 6B:
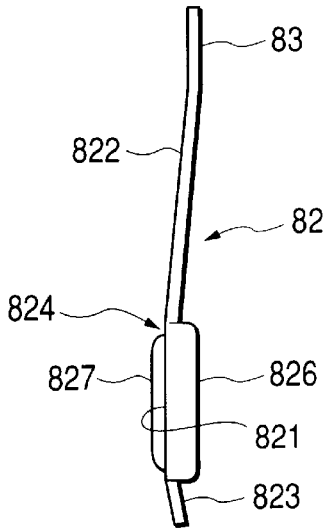

FIGS. 6A and 6B are plan and side views of a spring member constituting a suspension spring for explaining a second embodiment of the color cathode ray tube in accordance with the present invention, respectively. In this embodiment, a second flat portion 827 is formed to protrude toward the stud 9 (not shown) from the flat portion 821 continuous with the sloped portion 822 of the spring member 82 of the suspension spring.

The second flat portion 827 is press-formed completely around the engagement hole 825 to protrude toward the stud such that a step 824 is formed between the flat portion 821 and the second protuberant flat portion 827.

In this embodiment, a surface on the stud side of the second flat portion 827 formed with the engagement hole 825 is disposed nearer to the stud than in the first embodiment, and consequently, the tilt angle θ of the sloped portion 822 with respect to the joint portion 83 becomes greater than in the first embodiment. The amount of doming compensation is capable of being adjusted by adjusting the amount of the protrusion of the second flat portion 827 toward the stud and thereby controlling the tilt angle θ.

The present inventors have confirmed experimentally that, as in the case of the first embodiment, the above-explained advantages are secured by providing the engagement hole 825 in the protuberant central area 827 raised above the surrounding surface of the engagement portion 821 for protruding the engagement hole 825 toward the stud 9 such that a center of the engagement hole 825 engaged with the stud 9 is displaced toward the inner wall of the skirt portion of the panel portion 1 from an intersection of a longitudinal axis of the stud 9 with an imaginary plane projected from the resilient sloped portion 822.

Figure 7A:
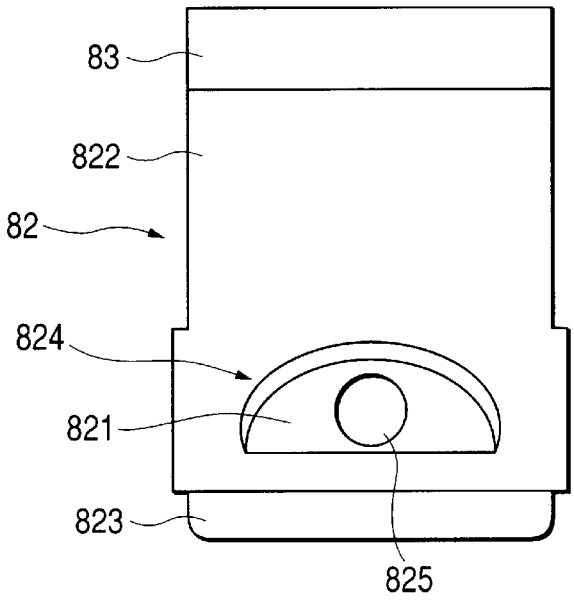
FIGS. 7A and 7B are plan and side views of a spring member constituting a suspension spring of a third embodiment of the color cathode ray tube in accordance with the present invention, respectively.
Figure 7B:
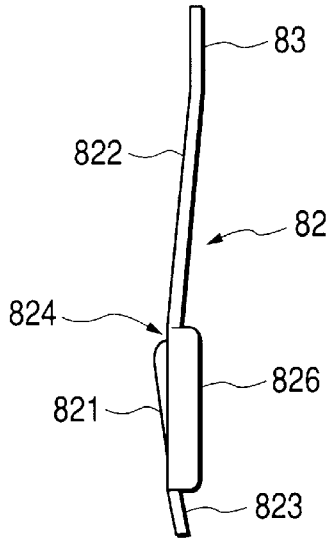

FIGS. 7A and 7B are plan and side views of a spring member constituting a suspension spring for explaining a third embodiment of the color cathode ray tube in accordance with the present invention, respectively. In this embodiment, the sloped portion 822 of the spring member 82 of the suspension spring is continuously extended to a portion corresponding to the flat portion 821 in the first and second embodiments such that the entire spring member 82 is tilted. The flat portion 821 is formed as a protuberant flat portion by locally protruding toward the stud a portion of the sloped portion 822 around the engagement hole 825 on its joint portion 83 side using a press, and consequently, a step 824 is formed between the sloped portion 822 and the protuberant flat portion 821. As its modification, the area of the sloped portion 822 entirely around the engagement hole 825 may be protruded toward the stud.

In this embodiment, like in the second embodiment, a surface on the stud side of the second flat portion 821 formed with the engagement hole 825 is disposed nearer to the stud, and consequently, the tilt angle θ of the sloped portion 822 with respect to the joint portion 83 becomes greater than in the first embodiment. The amount of doming compensation is capable of being adjusted by adjusting the amount of the protrusion of the second flat portion 821 toward the stud and thereby controlling the tilt angle θ.

The present inventors have confirmed experimentally that, as in the case of the first embodiment, the above-explained advantages are secured by providing the engagement hole 825 engaged with the stud 9 in a protuberant central area 821 raised above a surrounding surface of the resilient sloped portion 822 for protruding the engagement hole 825 toward the stud 9 such that a center of the engagement hole 825 engaged with the stud 9 is displaced toward the inner wall of the skirt portion of the panel portion 1 from an intersection of a longitudinal axis of the stud 9 with an imaginary plane projected from the resilient sloped portion 822.

The following explains an example of the overall configuration of the color cathode ray tube employing the above-explained suspension springs.

Figure 8:
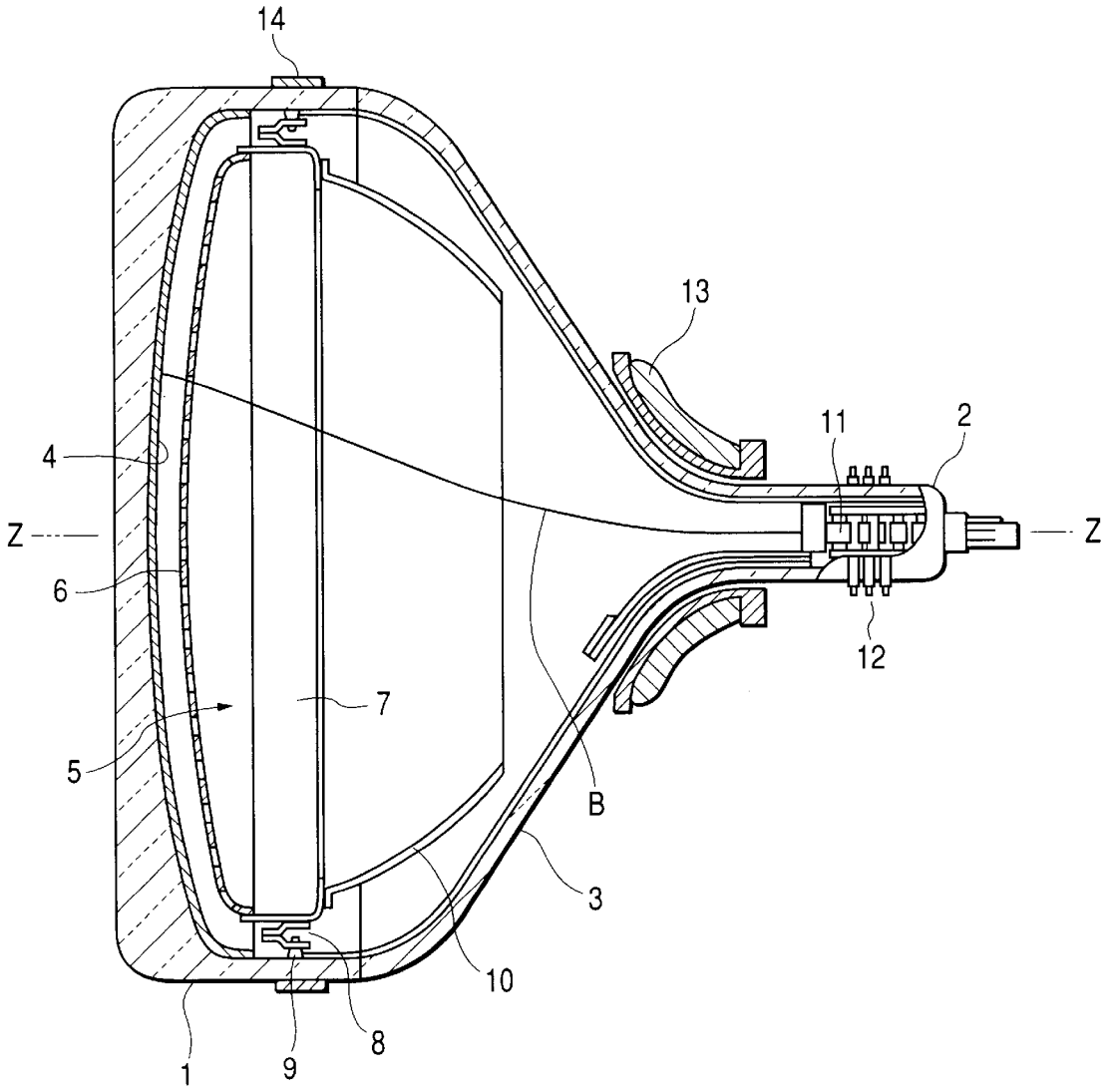
FIG. 8 is a schematic cross-sectional view of an embodiment of the color cathode ray tube in accordance with the present invention for explaining its exemplary overall construction.

FIG. 8 is a schematic cross-sectional view of an embodiment of the color cathode ray tube in accordance with the present invention for explaining its exemplary overall construction. FIG. 8 is a cross-sectional view of the color cathode ray tube taken along a plane containing the tube axis Z—Z and two corners of the panel portion 1, and each of the four studs 9 is embedded in the inner wall of the skirt portion at a respective corner of the panel portion 1.

The color cathode ray tube has the panel portion 1 in the shape of a generally rectangular shallow dish with a skirt portion at its periphery. The phosphor screen 4 is formed on the inner surface of the panel portion 1. The shadow mask structure 5 comprised of the frame 7, the shadow mask 6 and the suspension springs 8 is closely spaced from the phosphor screen within the panel portion 1. The electron gun 11 is housed within the cylindrical neck portion 2 coupled to the panel portion 1 via the funnel portion 3.

A deflection yoke 13 is mounted around the outside of the color cathode ray tube in the vicinity of a transition region between the funnel portion 3 and the neck portion 2, and magnetic devices 12 for color purity adjustment and static convergence adjustment are mounted around the neck portion 2. Reference numeral 14 in FIG. 8 denotes an implosion protection band tightly wound around the outside of the skirt portion of the panel portion 1.

The shadow mask structure 5 used in this color cathode ray tube is attached to the panel portion 1 by engaging the suspension springs 8 fixed at the corners of the shadow mask structure with studs 9, and the suspension springs 8 described in any of the above-described embodiments may be used.

The color cathode ray tubes of the above configurations are capable of providing a color misregister-free high-quality image.

As explained above, the color cathode ray tubes of the representative configurations of the present invention are capable of suppressing overcompensation for doming caused by the suspension springs, preventing color misregister due to temperature rise, and thereby providing a high-quality image. The color cathode ray tubes of the present invention are also capable of avoiding interference between the suspension springs and studs in removing and remounting of the shadow mask structure in their manufacturing process, preventing destruction of studs, and thereby improving efficiency in their manufacturing operation.

What is claimed is:

1. A color cathode ray tube comprising an evacuated envelope including a generally rectangular shallow dish-like panel portion having a peripheral skirt portion, a tubular neck portion, and a funnel portion for connecting said panel portion and said neck portion, an electron gun housed within said neck portion, a phosphor screen formed on an inner surface of said panel portion, a shadow mask structure closely spaced from said phosphor screen within said panel portion, said shadow mask structure comprising a generally rectangular peripheral support frame, a generally rectangular shadow mask having an apertured portion formed with a multiplicity of electron-transmissive apertures and a peripheral skirt portion, said shadow mask being attached at said peripheral skirt portion thereof to said support frame, and suspension springs attached to corners of said support frame corresponding to said corners of said panel portion, and a plurality of studs embedded in an inner wall of said skirt portion at corners of said panel portion for supporting said shadow mask structure, wherein each of said suspension springs comprises a base member fixed to a corresponding one of said corners of said support frame, and a spring member fixed at a panel-portion side end thereof to said base member; and said spring member includes a resilient sloped portion extending in a direction of a longitudinal axis of said color cathode ray tube from said panel-portion side end of said spring member, and bent toward said skirt portion of said panel portion from the direction of the longitudinal axis of said color cathode ray tube, an engagement portion formed with an engagement hole engaged with a corresponding one of said plurality of studs, and a generally step-like portion provided between said resilient sloped portion and said engagement portion for protruding said engagement portion toward said corresponding one of said plurality of studs such that a center of said engagement hole in a condition thereof engaged with said corresponding one of said plurality of studs is displaced toward said inner wall of said peripheral skirt portion of said panel portion from an intersection of a longitudinal axis of said corresponding one of said plurality of studs with an imaginary plane projected from said resilient sloped portion.

2. A color cathode ray tube according to claim 1, wherein said generally step-like portion is approximately linearly sloped.

3. A color cathode ray tube comprising an evacuated envelope including a generally rectangular shallow dish-like panel portion having a peripheral skirt portion, a tubular neck portion, and a funnel portion for connecting said panel portion and said neck portion, an electron gun housed within said neck portion, a phosphor screen formed on an inner surface of said panel portion, a shadow mask structure closely spaced from said phosphor screen within said panel portion, said shadow mask structure comprising a generally rectangular peripheral support frame, a generally rectangular shadow mask having an apertured portion formed with a multiplicity of electron-transmissive apertures and a peripheral skirt portion, said shadow mask being attached at said peripheral skirt portion thereof to said support frame, and suspension springs attached to corners of said support frame corresponding to said corners of said panel portion, and a plurality of studs embedded in an inner wall of said skirt portion at corners of said panel portion for supporting said shadow mask structure, wherein each of said suspension springs comprises a base member fixed to a corresponding one of said corners of said support frame, and a spring member fixed at a panel-portion side end thereof to said base member; and said spring member includes a resilient sloped portion extending in a direction of a longitudinal axis of said color cathode ray tube from said panel-portion side end of said spring member, and bent toward said skirt portion of said panel portion from the direction of the longitudinal axis of said color cathode ray tube, and an engagement portion continuous with said resilient sloped portion and having an engagement hole engaged with a corresponding one of said plurality of studs, said engagement hole being made in a protuberant central area raised above a surrounding surface of said engagement portion for protruding said engagement hole toward said corresponding one of said plurality of studs such that a center of said engagement hole in a condition thereof engaged with said corresponding one of said plurality of studs is displaced toward said inner wait of said peripheral skirt portion of said panel portion from an intersection of a longitudinal axis of said corresponding one of said plurality of studs with an imaginary plane projected from said resilient sloped portion.

4. A color cathode ray tube comprising an evacuated envelope including a generally rectangular shallow dish-like panel portion having a peripheral skirt portion, a tubular neck portion, and a funnel portion for connecting said panel portion and said neck portion, an electron gun housed within said neck portion, a phosphor screen formed on an inner surface of said panel portion, a shadow mask structure closely spaced from said phosphor screen within said panel portion, said shadow mask structure comprising a generally rectangular peripheral support frame, a generally rectangular shadow mask having an apertured portion formed with a multiplicity of electron-transmissive apertures and a peripheral skirt portion, said shadow mask being attached at said peripheral skirt portion thereof to said support frame, and suspension springs attached to corners of said support frame corresponding to said corners of said panel portion, and a plurality of studs embedded in an inner wall of said skirt portion at corners of said panel portion for supporting said shadow mask structure, wherein each of said suspension springs comprises a base member fixed to a corresponding one of said corners of said support frame, and a spring member fixed at a panel-portion side end thereof to said base member; and said spring member includes a resilient sloped portion extending in a direction of a longitudinal axis of said color cathode ray tube from said panel-portion side end of said spring member, and bent toward said skirt portion of said panel portion from the direction of the longitudinal axis of said color cathode ray tube, and an engagement hole engaged with a corresponding one of said plurality of studs is made in a protuberant central area raised above a surrounding surface of said resilient sloped portion for protruding said engagement hole toward said corresponding one of said plurality of studs such that a center of said engagement hole in a condition thereof engaged with said corresponding one of said plurality of studs is displaced toward said inner wall of said peripheral skirt portion of said panel portion from an intersection of a longitudinal axis of said corresponding one of said plurality of studs with an imaginary plane projected from said resilient sloped portion.

5. A color cathode ray tube according to claim 1, wherein a thickness of said base member is greater than a thickness of said resilient sloped potion.

6. A color cathode ray tube according to claim 3, wherein a thickness of said base member is greater than a thickness of said resilient sloped potion.

7. A color cathode ray tube according to claim 4, wherein a thickness of said base member is greater than a thickness of said resilient sloped potion.

8. A color cathode ray tube according to claim 1, where the intersection of the longitudinal axis of said corresponding one of said plurality of V studs with the imaginary plane projected from said resilient sloped portion is obtained at the imaginary plane projected from a surface of said resilient sloped portion which faces said inner wall of said peripheral skirt portion of said panel portion.

9. A color cathode ray tube according to claim 3, where the intersection of the longitudinal axis of said corresponding one of said plurality of studs with the imaginary plane projected from said resilient sloped portion is obtained at the imaginary plane projected from a surface of said resilient sloped portion which faces said inner wall of said peripheral skirt portion of said panel portion.

10. A color cathode ray tube according to claim 4, where the intersection of the longitudinal axis of said corresponding one of said plurality of studs with the imaginary plane projected from said resilient sloped portion is obtained at the imaginary plane projected from a surface of said resilient sloped portion which faces said inner wall of said peripheral skirt portion of said panel portion.

* * * * *